US008047458B2

(12) United States Patent
Nied et al.

(10) Patent No.: US 8,047,458 B2
(45) Date of Patent: Nov. 1, 2011

(54) METHOD FOR PRODUCING VERY FINE PARTICLES BY MEANS OF A JET MILL

(75) Inventors: Roland Nied, Bonstetten (DE); Hermann Sickel, Münzenberg (DE)

(73) Assignees: Roland Nied, Bonstetten (DE); Netzsch-Condux Mahltechnik GmbH, Selb (DE)

( * ) Notice: Subject to any disclaimer, the term of this patent is extended or adjusted under 35 U.S.C. 154(b) by 184 days.

(21) Appl. No.: 12/297,510

(22) PCT Filed: May 18, 2007

(86) PCT No.: PCT/DE2007/000903

§ 371 (c)(1), (2), (4) Date: Mar. 11, 2009

(87) PCT Pub. No.: WO2007/131502

PCT Pub. Date: Nov. 22, 2007

(65) Prior Publication Data

US 2009/0294557 A1 Dec. 3, 2009

(30) Foreign Application Priority Data

May 17, 2006 (DE) ..... 10 2006 023 193

(51) Int. Cl.
*B02C 19/06* (2006.01)

(52) U.S. Cl. ..... 241/5; 241/19; 241/23

(58) Field of Classification Search ..... 241/5, 23, 241/39, 40, 65, 19

See application file for complete search history.

(56) References Cited

U.S. PATENT DOCUMENTS

| | | | | |
|---|---|---|---|---|
| 3,877,647 | A * | 4/1975 | Gorobets et al. | 241/39 |
| 5,252,110 | A | 10/1993 | Nied | |
| 6,383,706 | B1 * | 5/2002 | Kumar et al. | 430/137.18 |
| 7,713,614 | B2 * | 5/2010 | Chow et al. | 428/220 |
| 2010/0065668 | A1 | 3/2010 | Nied | |

FOREIGN PATENT DOCUMENTS

| | | |
|---|---|---|
| DE | 3140294 | 4/1983 |
| DE | 3620440 | 12/1987 |
| DE | 3825469 | 2/1990 |
| DE | 19824062 | 12/1999 |
| EP | 021117 | 5/1980 |
| EP | 0211117 A2 | 2/1987 |
| EP | 0472930 | 7/1991 |
| EP | 1080786 | 8/2000 |
| GB | 1481304 | 7/1977 |
| WO | WO 2007/118460 | 10/2007 |

OTHER PUBLICATIONS

International Search Report for PCT/DE2007/000903 published on Nov. 22, 2007.

International Search Report for PCT/DE2007/000649 published on Oct. 25, 2007.

(Continued)

*Primary Examiner* — Mark Rosenbaum

(74) *Attorney, Agent, or Firm* — Martin Fleit; Paul D. Bianco; Fleit Gibbons Gutman Bongini & Bianco PL

(57) ABSTRACT

The invention relates to a method for producing very fine particles by means of a jet mill using compressed gases as the grinding gas, characterized in that the grinding gas is under pressure of ≦4.5 bar(abs).

10 Claims, 2 Drawing Sheets

OTHER PUBLICATIONS

Karl Hoffl, Zerkleinerungs- und Klassiermaschinen, 1986, Springer-Verlag, Berlin Heidelnerg New York Tokyo, XP002450092.

English translation of the Written Opinion of the International Searching Authority published Apr. 30, 2009 for PCT/DE2007/000903 filed May 18, 2007.

English translation of the International Preliminary Report on Patentability published May 5, 2009 for PCT/DE2007/000903 filed May 18, 2007.

English translation of the Written Opinion of the International Searching Authority published Nov. 14, 2008 for PCT/DE2007/000649 filed Apr. 13, 2007.

English translation of the International Preliminary Report on Patentability published Nov. 17, 2008 for PCT/DE2007/000649 filed Apr. 13, 2007.

* cited by examiner

METHOD FOR PRODUCING VERY FINE PARTICLES BY MEANS OF A JET MILL

FIELD OF THE INVENTION

The present invention relates to a method for producing very fine particles by means of a jet mill.

BACKGROUND OF THE INVENTION

The material to be sieved or milled consists of coarser and finer particles which are entrained in an air stream, and which form the product stream that is introduced into a housing of an air classifier of the jet mill. The product stream reaches, in the radial direction, a sieve wheel of the air classifier. In the sieve wheel, the coarser particles are separated from the air stream, and the air stream with the fine particles axially leave the sieve wheel through an outflow pipe. The air stream with the fine particles to be removed by filtration or to be produced can then be fed to a filter, in which a fluid, for example, air, and fine particles are separated from each other.

From DE 198 24 062 A1, a jet mill is known into whose milling chamber moreover at least one energy-rich grinding stream made of hot steam with high flow energy is introduced, where the milling chamber has, besides the inlet device for the at least one milling jet, an inlet for the mill material and an outlet for the product, and where, in the area where the mill material and at least one milling jet made of hot steam and mill material have at least approximately the same temperature in the area where they converge.

Furthermore, a corresponding air classifier is known particularly for a jet mill, for example, from EP 0 472 930 B1. This air classifier and its operating procedure are quite satisfactory in principle.

SUMMARY OF THE INVENTION

The problem of the present invention, therefore, is to further optimize a method for the generation of very fine particles by means of a jet mill.

This goal is realized with a method for producing very fine particles in accordance with claim 1.

Accordingly, the method for producing very fine particles by means of a jet mill using compressed gases as the grinding gas is characterized in that the grinding gas has a pressure of $\leqq 4.5$ bar(abs).

As a result, in an advantageous way, a method is provided for the operation with energy optimization of a jet mill by means of compressed gases.

In a preferred variant, jet milling of inorganic substances occurs using the grinding gas.

The method can moreover be further improved preferably by using the grinding gas at a temperature >100° C., where, in particular, the temperature of the grinding gas is in the range of approximately 180° C. to approximately 200° C.

Furthermore, it is advantageous with the method to provide for the following, first, the specific adiabatic energy consumption of a milling process is determined using a grinding gas pressure of >7 bar(abs), then, the specific adiabatic energy consumption of the same grinding process is determined using a grinding gas pressure of <4.5 bar(abs), and the two energy consumptions are compared and in the case where $$E_{ad,spec}(4.5) \leqq E_{ad,spec}(7),$$

the low pressure area is chosen.

It is preferred to use a fluidized bed jet mill or a dense bed jet mill.

It is preferred for the determination of the two energy consumptions and their comparison to occur each time the operation of the jet mill is started or resumes. Here it is particularly advantageous for the determination of the two energy consumptions and their comparison to be carried out automatically. It is particularly advantageous if an operating mode setting according to the result of the comparison also occurs automatically.

Furthermore, it is advantageous to use a dynamic air classifier that is integrated in the jet mill. Moreover, it is advantageous to provide for the air classifier to contain a sieve rotor or a sieve wheel with a clearance height that increases with decreasing radius, so that during the operation the surface area of the sieve rotor or wheel through which the flow occurs is at least approximately constant. Alternatively or additionally, one can provide for the air classifier to contain a sieve rotor or sieve wheel within, a replaceable immersion pipe that is designed in such a way that it turns with the sieve rotor or the sieve wheel.

Yet another advantageous embodiment of the method consists in providing a fine material outlet chamber that has a cross-sectional enlargement in the flow direction.

Preferred and/or advantageous embodiments of the invention are obtained from the claims and their combinations as well as the entire submitted application documentation.

BRIEF DESCRIPTION OF THE DRAWINGS

The invention is explained in greater detail, merely as an example, using the embodiment examples below and in reference to the drawing, in which.

DETAILED DESCRIPTION OF THE INVENTION

Figure 1:
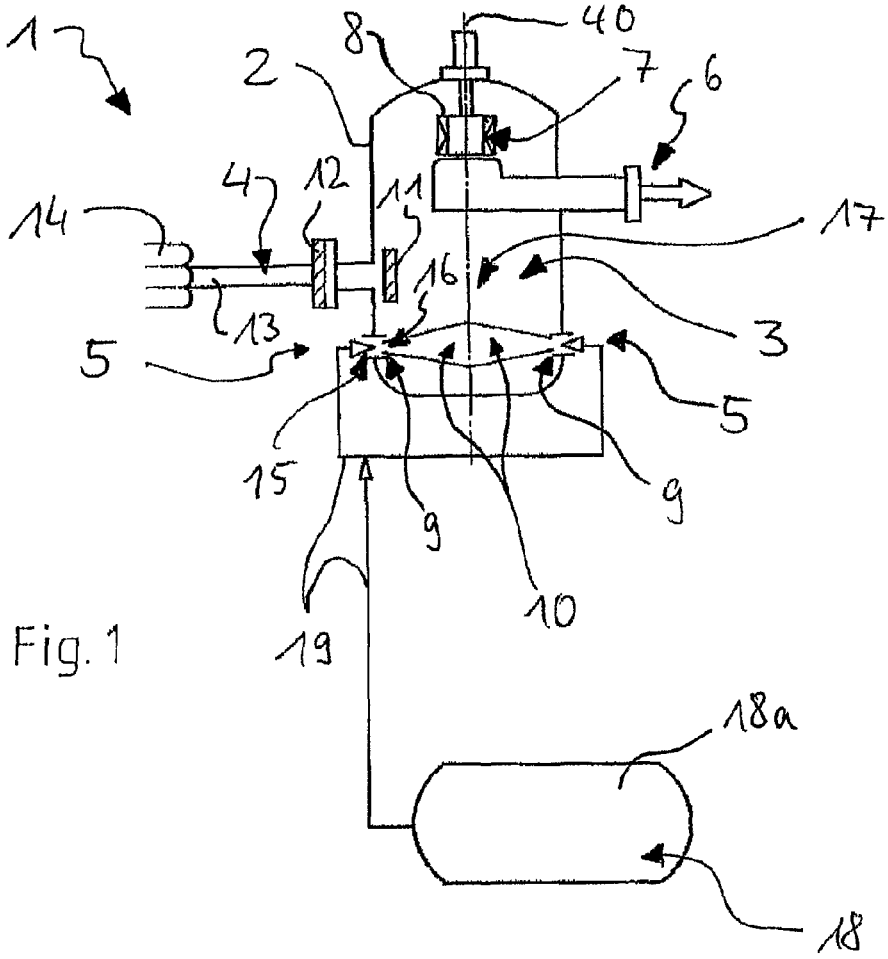
FIG. 1 shows in diagrammatic fashion an embodiment example of a jet mill in a schematic drawing with partial cross section.

Using the embodiment and application examples described below and represented in the drawing, the invention is explained in greater detail merely as an example, i.e., it is not limited to the embodiment and application examples or to the given combinations of characteristics within individual embodiment and application examples. The process and device characteristics are obtained in each case analogously also from the device and process descriptions.

Individual characteristics that are indicated and/or represented in connection with actual embodiment examples are not limited to these embodiment examples or the combination with the remaining characteristics of these embodiment examples, rather they can be combined in the context of what is technically possible with any other variants, even if they are not discussed separately in the present documentation.

Identical reference designators in the individual figures and representations of the drawing denote identical or similar or identically or similarly functioning components. Using the representations in the drawing, characteristics also become clear that are not provided with reference designators, regardless of whether such characteristics are described below. On the other hand, characteristics that are contained in the present description but are not visible or represented in the drawing are also understandable without difficulty by a person skilled in the art.

In the method for producing very fine particles by means of a jet mill, the new steps provided according to the present invention are sufficiently clear and understandable that a graphic representation of the individual steps is not necessary.

In the method for producing very fine particles by means of a jet mill with the use of compressed gases as the grinding gas, it is provided that the grinding gas have a pressure of ≦4.5 bar(abs). As a result, in an advantageous way, a method is produced for the energetically optimized operation of a jet mill by means of compressed gases.

In a preferred embodiment, a jet milling of inorganic substances occurs with the grinding gas. The method can moreover be improved advantageously by using the grinding gas at a temperature >100° C., particularly a temperature of the grinding gas in the range from approximately 180° C. to approximately 200° C.

Furthermore, according to the invention, in the method for operating a jet mill, such as, for example, a fluidized bed jet mill, with the specific adiabatic energy consumption of a grinding process using a grinding gas pressure of >7 bar(abs) is determined using sensors and processor devices that are well known to a person skilled in the art, so that their design need not be discussed further here. Advantageously, the value of the specific adiabatic energy consumption obtained at a grinding gas pressure of >7 bar(abs) is transferred to a memory. Then, using the same sensors and processor devices, the specific adiabatic energy consumption of the same grinding process is determined using a grinding gas pressure of <4.5 bar(abs). This value of the specific adiabatic energy consumption at a grinding gas pressure of <4.5 bar(abs) is preferably also read into a memory. The two energy consumptions are compared, for example, using the processor devices that were used for the determination of the energy consumptions, or others, and in the case where $$E_{ad,spec}(4.5) \leqq E_{ad,spec}(7)$$

the low pressure area for the operation of the jet mill is chosen. Besides the fact that the corresponding operating mode can be set manually according to the result of the comparison which, for example, is displayed visually on appropriate known devices, an automatic setting of the corresponding operating mode according to the result of the comparison is also possible, if an appropriate control is present and connected with, on the one hand, the processor devices that determine the comparison result as well as, on the other hand, with control devices so that the control as a function of the result of the comparison in accordance with the process devices causes the control devices to set the corresponding operating mode.

The method according to the invention is carried out preferably before each new operation of the jet mill, particularly with new material to be milled, and it is thus a component of the overall operating procedure of the jet mill.

Furthermore, it is preferred that a dynamic air classifier that is integrated in the jet mill be used. Moreover, it is preferred that here the air classifier contain a sieve rotor or a sieve wheel with a clearance height that increases with decreasing radius, so that during the operation, the surface area of the sieve rotor or wheel through which flow occurs is at least approximately constant. Alternatively or additionally the air classifier can contain a sieve rotor or a sieve wheel with, in particular, a replaceable immersion pipe, which is designed in such a way that it turns with the sieve rotor or the sieve wheel.

Another advantageous embodiment of the method provides a fine material outlet chamber that presents a cross-sectional enlargement in the flow direction.

In FIG. 1, an embodiment example of a jet mill 1 for carrying out the above described method is represented schematically. As already presented above, the method according to the invention can be carried out manually or in an automated way, which has no fundamental influence on the use of the method. The automated variant naturally allows a further reduction of the operating expense and it is achievable without difficulty using devices and means that are already known to the person skilled in the art, where, however, the intent is not to indicate that the person skilled in the art would also know the individual steps of the method, which was newly produced by the present invention. In any case, details regarding the sensor, measuring, processor, storage and control devices as well as control in general and in particular, do not appear not to be necessary, because this conversion in terms of devices of the method according to the invention, if it is known, requires no separate inventive steps.

The jet mill 1 according to FIG. 1 contains a cylindrical housing 2, which encloses a milling chamber 3, a milling material feed 4 located approximately at half the height of the milling chamber 3, at least one milling jet inlet 5 in the lower area of the milling chamber 3, and a product outlet 6 in the upper area of the milling chamber 3. There, an air classifier 7 with a rotatable sieve wheel 8 is arranged, by which means the mill material (not shown) is sorted so that only mill material under a certain grain size is removed through the product outlet 6 from the milling chamber 3, and mill material having a grain size above the chosen value is fed to an additional grinding process.

The sieve wheel 8 can be a sieve wheel as is usual for air classifiers, with blades (see below, for example, in connection with FIG. 3) that run radially and delimit blade channels, where the sieve air enters at the channels' outer ends, and entrains particles with smaller grain size or weight to the central outlet and to the product outlet 6, while larger particles or particles with greater weight are rejected under the influence of the centrifugal force. In particular, the air classifier 7 and/or at least its sieve wheel 8 are equipped with at least one design characteristic according to EP 0 472 930 B1.

Only one milling jet inlet 5 may be provided, for example, one consisting of a single, radially oriented, inlet opening or inlet nozzle 9, causing a single milling jet 10 to collide at high energy with the mill material particles, which get from the mill material feed 4 into the area of the milling jet 10, and allow the mill material particles to be decomposed into small partial particles, which are drawn up by the sieve wheel 8 and, to the extent that they have an appropriately small size or weight, they are conveyed outwards through the product outlet 6. However, a better effect is achieved with paired, diametrically opposite, milling jet inlets 5, which form two mutually impacting milling jets 10 that perform the particle decomposition more intensively than is possible with only one milling jet 10, particularly if several milling jet pairs are generated.

Furthermore, the processing temperature can be influenced by using, for example, an internal heat source 11 between the mill material feed 4 and the area of the milling jets 10 or a corresponding heat source 12 in the area outside of the mill material feed 4, or by processing particles of a material to be milled that is already warm and that reaches, while avoiding heat losses, the mill material feed 4, for which purpose a feed pipe 13 is surrounded by a heat insulation jacket 14. The heat source 11 or 12, if it is used, can in principle be of any type, and therefore it can be chosen for the intended purpose from ready-for-use commercial products, depending on availability, so that no additional explanations on this topic are required.

As for the temperature, it is above all the temperature of the milling jet or of the milling jets 10 that is relevant, and the temperature of the material to be milled should at least correspond approximately to this milling jet temperature.

For the purpose of the milling jets 10 that are introduced through the milling jet inlets 5 into the milling chamber 3, it is possible to use, for example, hot steam or any other appropriate fluid. When hot steam is used, it must be assumed that the heat content of the water vapor after the inlet nozzle 9 of the given milling jet inlet 5 is not substantially smaller than before this inlet nozzle 9. Because the energy required for crushing by impact should be available primarily as flow energy; the pressure decrease, in comparison, between the inlet 15 of the inlet nozzle 9 and its outlet 16 will be large (the pressure energy is largely converted into flow energy) and the temperature decrease will also not be negligible. In particular, this temperature decrease should be compensated by the heating of the mill material to such an extent that the material to be milled and the milling jet 10 in the area of the center 17 of the milling chamber 3 have the same temperature, in the case of at least two mutually impacting milling jets 10 or a multiple of two milling jets 10.

For the design and carrying out of the workup of the milling jet 10 of hot vapor, particularly in the form of a closed system, reference is made to DE 198 24 062 A1, whose entire disclosure content is incorporated by reference to avoid simple repetition of the present cross reference. Using a closed system, it is possible, for example, to carry out the milling of hot slag as mill material with an optimal degree of effectiveness.

In the representation of the present embodiment example of the jet mill 1, it is possible to substitute any feed of an operating means or operating medium B with a reservoir or a production device 18, as represented, for example, by a tank 18*a*, where the operating means or operating medium B is led via the line devices 19 to the milling jet inlet 5 or the milling jet inlets 5 for the formation of the milling jet 10 or the milling jets 10. Instead of the tank 18*a* one can also use, for example, a compressor, to make available an appropriate operating medium B.

In particular, starting from a jet mill 1, which is equipped with such an air classifier 7, where the pertinent embodiment example here must be considered to be merely an example and must not be understood to have a limiting intent, a method for producing very fine particles is carried out with this jet mill 1 with an integrated dynamic air classifier 7. As operating means B, a fluid is generally used, preferably the already mentioned water vapor, or hydrogen gas, helium gas, or simply air.

Moreover, it is advantageous and therefore preferred for the sieve rotor 8 to present a clearance height that increases with decreasing radius, i.e., toward its axis, where the surface area of the sieve rotor 8 through which there is flow is particularly constant. In addition or alternatively, a very fine material outlet chamber (not shown) can be provided that has an enlarged cross section in the flow direction.

There is a particularly preferred embodiment example of the jet mill 1 in which the sieve rotor 8 has a replaceable, co-rotating immersion pipe 20.

Solely for the sake of explanation and enhancing overall comprehension, the particles to be produced from the material to be preferably processed is discussed below. For example, the material may be amorphous $SiO_2$ or other amorphous chemical products that are crushed with the jet mill. Other materials are silicic acids, silica gels or silicates or materials with a carbon black content.

Below, with reference to FIGS. 2 and 3, additional details and variants of exemplary embodiments of the jet mill 1 and its components are explained.

Figure 2:
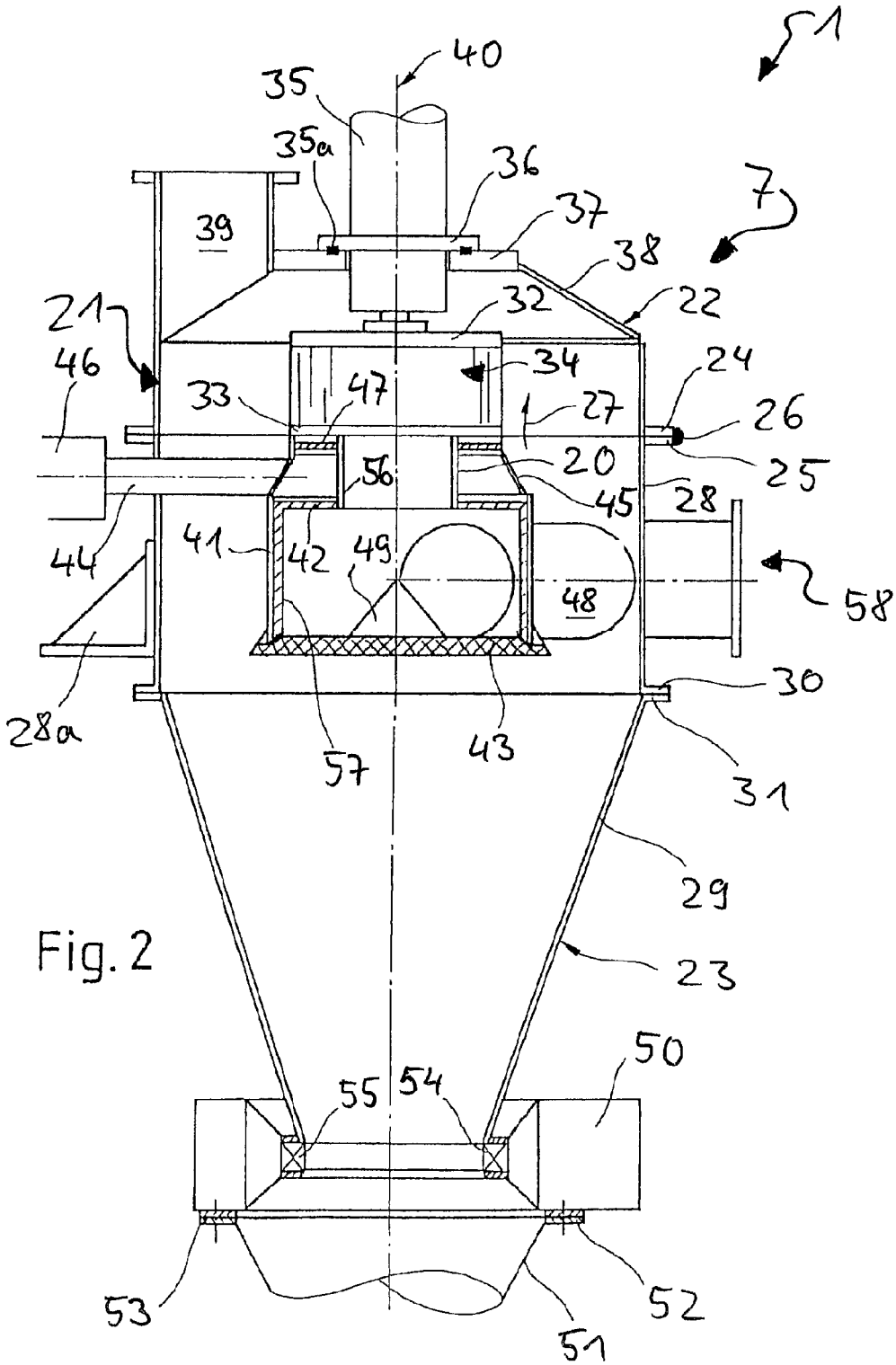
FIG. 2 shows an embodiment example of an air classifier of a jet mill in a vertical arrangement and as a schematic median cross section, where the outlet pipe for the mixture of sieving air and solid particles is associated with the sieving wheel.

The jet mill 1 contains, as can be seen in the schematic representation in FIG. 2, an integrated air classifier 7, which consists, for example, in construction types of the jet mill 1 as a fluidized bed jet mill or a dense bed jet mill, of a dynamic air classifier 7, which is arranged advantageously in the center of the milling chamber 3 of the jet mill 1. The desired fineness of the material to be milled can be influenced as a function of the grinding gas volume stream and the number of revolutions of the sieve.

In the air classifier 7 of this jet mill 1 according to FIG. 2, the entire vertical air classifier 7 is enclosed by a sieve housing 21, which consists essentially of the housing upper part 22 and the housing bottom part 23. The housing upper part 22 and the housing bottom part 23 are provided at the upper respective lower edge each with an circumferential flange 24 or 25 that is directed outwards. The two circumferential flanges 24, 25, in the installed or operating state of the air classifier 8 lie one above the other, and are fixed together by an appropriate means. Suitable means for fixation are, for example, screw connections (not shown). As detachable fixation means one can also use clamps (not shown) or similar devices.

At practically any place of the flange periphery, both circumferential flanges 24 and 25 are interconnected by an articulation 26 in such a way that the housing upper part 22 can be swiveled upward in the direction of arrow 27 after detachment of the flange connection means, with respect to the housing bottom part 23, and the housing upper part 22 is accessible from below and the housing upper part 23 is accessible from above. The housing bottom part 23, for its part, is designed in two parts, and it essentially consists of the cylindrical sieve space housing 28 with the circumferential flange 25 at its upper open end and a discharge cone 29, which tapers conically downward. The discharge cone 29 and the sieve space housing 28 lie one on the other at the upper or lower end with flanges 30, 31, respectively, and the two flanges 30, 31 of discharge cone 29 and the sieve space housing 28 are interconnected like circumferential flanges 24, 25 by means of detachable fixation means (not shown). The sieve housing 21 that has been assembled in this way is suspended in or on support arms 28*a*, of which several are distributed, possibly evenly spaced, about the periphery of the sieve or compaction housing 21 of the air classifier 7 of the jet mill 1, and engage on the cylindrical sieve space housing 28.

An essential part of the housing inserts of the air classifier 7 is again the sieve wheel 8 with an upper cover disk 32, with a lower outflow-side cover disk 33, which is axially separated from the former disk, and with blades 34 having an advantageous contour, which are arranged between the external margins of the two cover disks 32 and 33, firmly connected to them, and evenly distributed over the periphery of the sieve wheel 8. With this air classifier 7, the drive of the sieve wheel 8 over the upper cover disk 32 is effected, while the lower cover disk 33 is the outflow-side cover disk. The mounting of the sieve wheel 8 comprises a sieve wheel shaft 35 which is advantageously forcefully driven, and whose upper end leads out of the sieve housing 21, and which carries without rotational play with its lower end, within the sieve housing 21, the sieve wheel 8 in a cantilever support. The leading of the sieve wheel shaft 35 from the sieve housing 21 occurs in a pair of machined plates 36, 37, which close off the sieve housing 21 at the upper end of the housing end section 38 that runs upward forming a truncated cone, which guide the sieve wheel shaft 35, and seal off this shaft passage without impeding the rotational movements of the sieve wheel shaft 35. It is advantageous for the upper plate 36 to be rotatably attached as a flange to the sieve wheel shaft 35, and to be supported via the pivot bearing 35*a* rotatably on the bottom plate 37, which in turn is associated with the housing end section 38. The bottom side of the outflow-side cover disk 33 lies in the common plane between the circumferential flanges 24 and 25, so that the sieve wheel 8 is arranged in its entirety within the hinged housing upper part 22. In the area of the conical housing end section 38, the housing upper part 22 also has a tubular product feed connector 39 of the mill material feed 4, whose longitudinal axis runs parallel to the axis of rotation 40 of the sieve wheel 8 and of its drive or sieve wheel shaft 35, and which is arranged as far as possible from this axis of rotation 40 of the sieve wheel 8 and of its drive or sieve wheel shaft 35, on the housing upper part 22 in a radially outward position.

The sieve housing 21 takes up the tubular outlet connector 20, which is arranged coaxially with sieve wheel 8, where the outlet connector is located with its upper end closely beneath the outflow-side cover disk 33 of the sieve wheel 8 but without being connected to it. On the lower end of the outlet connector 20, which is designed as a tube, an outlet chamber 41 is attached coaxially, where the outlet chamber is also tubular but with a substantially larger diameter than the diameter of the outlet connector 20, and in the present embodiment example, at least twice as large as the diameter of the outlet connector 20. In the transition between the outlet connector 20 and the outlet chamber 41, there is a clear jump in diameter. The outlet connector 20 is inserted in an upper cover plate 42 of the outlet chamber 41. The outlet chamber 41 is closed by a removable cover 43 below. The structural unit consisting of the outlet connector 20 and the outlet chamber 41 is held in several support arms 44, which are evenly distributed in a star pattern about the periphery of the structural unit, with their inner ends in the area of the outlet connector 20 firmly connected to the structural unit and with its external end connected to the sieve housing 21.

The outlet connector 20 is surrounded by a conical annular housing 45, whose lower, larger external diameter corresponds at least approximately to the diameter of the outlet chamber 41, and whose upper, smaller external diameter corresponds at least approximately to the diameter of the sieve wheel 8. The support arms 44 end on the conical wall of the annular housing 45 and they are firmly connected to this wall, which is itself also part of the structural unit consisting of the outlet connectors 20 and the outlet chamber 41.

The support arms 44 and the annular housing 45 are part of a scavenging air installation (not shown) where the scavenging air prevents the penetration of material from the inner space of the sieve housing 21 in the slit between the sieve wheel 8 or more precisely its lower cover disk 3 and the outlet connector 20. In order to allow this scavenging air to reach the annular housing 45 and from there the slit that is to be kept clear, the support arms 44 are designed as pipes, passed with their external end sections through the wall of the sieve housing 21, and connected via a suction filter 46 to a scavenging air source (not shown). The annular housing 45 is closed off upwardly by a perforated plate 47, and the slit itself can be set by an axially adjustable annular disk in the area between the perforated plate 47 and the lower cover disk 33 of the sieve wheel 8.

The discharge from the outlet chamber 41 is formed by a fine material discharge pipe 48, which is introduced from the outside into the sieve housing 21 and connected in a tangential arrangement to the outlet chamber 41. The fine material discharge pipe 48 is a component of the production outlet 6. The casing of the inlet mouth of the fine material discharge pipe 48 on the outlet chamber 41 functions as a rejection cone 49.

At the lower end of the conical housing end section 38, in a horizontal arrangement, a sieve air inlet spiral 50 and a coarse material discharge 51 are associated with a housing end section 38. The rotation direction of the sieve air inlet spiral 50 is opposite the rotation direction of the sieve wheel 8. The coarse material discharge 51 is associated in a detachable way with the housing end section 38, where a flange 52 is associated with a lower end of the housing end section 38 and a flange 53 is associated with the upper end of the coarse material discharge 51, and both flanges 52 and 53 in turn are interconnected detachably by known means, when the air classifier 7 is ready to be operated.

The dispersion zone to be constructed is designated 54. Flanges that are machined (chamfered) on the inner edge for clean stream guidance and a simple casing are designated 55.

Finally, on the inner wall of the outlet connector 20, a replaceable protection pipe 56 is also applied as a part subject to wear, and a corresponding replaceable protection pipe 57 can be applied against the inner wall of the outlet chamber 41.

At the beginning of the operation of the air classifier 7 in the represented operating state, sieve air is introduced through the sieve air inlet spiral 50 into the air classifier 7 under a pressure gradient and with an appropriately selected inlet speed. As a result of the introduction of this sieve air by means of a spiral, particularly in connection with the conicity of the housing end section 38, the sieve air rises in a spiral pattern upward into the area of the sieve wheel 8. At the same time, the "product" made up of solid particles of different weight is introduced via the product feed connector 39 into the sieve housing 21. Of this product, the coarse material, i.e., the particle portion of greater weight, reaches, against the sieve air, the area of the coarse material discharge 51 and it is readied for further processing. The fine material, i.e., the particle portion with smaller weight, is mixed with the sieve air, and it reaches, moving from the outside radially inward through the sieve wheel 8, the outlet connector 20, into the outlet chamber 41, and finally via a fine material outlet pipe 48 in a fine material outlet or discharge 58, and then from there it reaches a filter in which the operating means in the form of a fluid, such as air, for example, and the fine material are separated from each other. Coarser fine material components are flung radially out of the sieve wheel 8 and admixed with a coarse material, and then they leave the sieve housing 21 with the coarse material or circulate in the sieve housing 21 until it has become fine material of a grain size such that it can be discharged with the sieve air.

As a result of the abrupt cross-sectional enlargement of the outlet connector 20 to the outlet chamber 41, a clear reduction in the flow speed of the fine material-air mixture occurs there. This mixture will thus reach, at a very slow flow velocity, through the outlet chamber 41 via the fine material outlet 48 into the fine material outlet 58, and generate abrasion to only a small extent on the wall of the outlet chamber 41. Therefore, the protection pipe 57 is also only a highly preventive measure. The flow velocity in this sieve wheel 8, which for reasons pertaining to good separation technology is high, exists, however, still in the discharge or outlet connector 20, and therefore the protection pipe 56 is more important than the protection pipe 57. The jump in diameter associated with a diameter enlargement is particularly important in the transition from the outlet connector 20 into the outlet chamber 41.

Moreover, the air classifier 7 can also be maintained properly due to the subdivision of the sieve housing 21 in the described way and the association of the sieve components with the individual partial housings, and components that have become damaged can be replaced at relatively low cost and short repair times.

Figure 3:
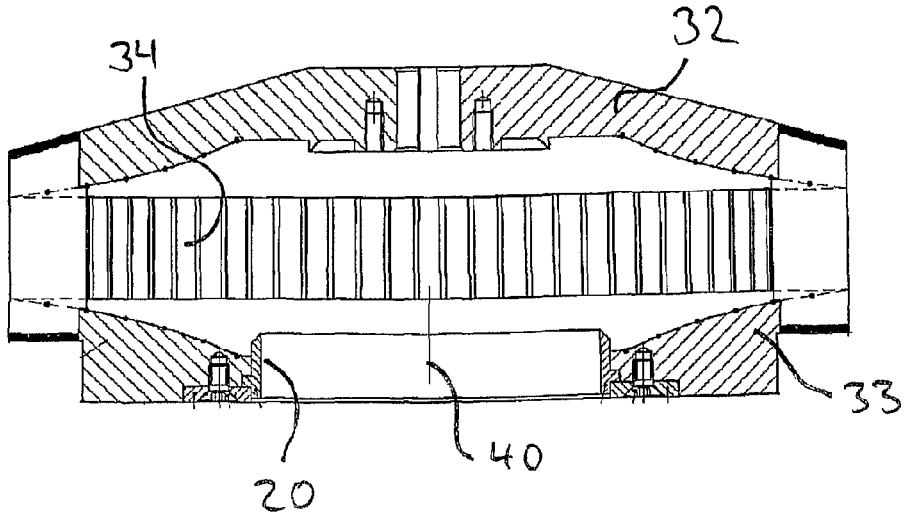
FIG. 3 shows in a schematic representation and as a vertical cross section a sieve wheel of an air classifier.

Whereas in the schematic representation of FIG. 2, the sieve wheel 8, with the two covered disks 32 and 33 and the blade ring 59 with the blades 34, which is arranged between the disks, is still represented in an already known, usual form with parallel and parallel-surface cover disks 32 and 33, in FIG. 3, the sieve wheel 8 for an additional embodiment example of the air classifier 7 is represented in an advantageous variant.

Besides the blade ring 59 with the blades 34, said sieve wheel 8 according to FIG. 3 also contains the upper cover disk 32 and the lower outflow-side cover disk 33, which is axially spaced from the former cover disk, and which can be rotated about the axis of rotation 40 and thus the longitudinal axis of the air classifier 7. The diametric extension of the sieve wheel 8 is perpendicular to the axis of rotation 40, i.e., to the longitudinal axis of the air classifier 7, regardless whether the axis of rotation 40 and thus, the mentioned longitudinal axis stands vertically or runs horizontally. The lower outflow-side cover disk 33 concentrically encloses the outlet connector 20. The blades 34 are connected to the two cover disks 33 and 32. The two cover disks 32 and 33 are now designed conically, unlike the state of the art, and preferably in such a way that the separation between the upper cover disk 32 and the outflow-side cover disk 33 increases from the ring 59 of the blades 34 inwardly, i.e., toward the axis of rotation 40, and preferably continuously, such as, for example, linearly or non-linearly, and also advantageously in such a way that the surface of the cylinder jacket through which flow occurs remains constant for each radius between the blade outlet edges and the outlet connectors 20. The outflow speed, which as a result of the decreasing radius becomes smaller in the known solutions, remains constant with this solution.

With the exception of the variant of the design of the upper cover disk 32 and the lower cover disk 33, which is explained above and in FIG. 3, it is also possible that only one of these two cover disks 32 or 33 is designed conically in the mentioned way, while the other conical disk 33 or 32, respectively, is flat, as is the case in connection with the embodiment example according to FIG. 2 for both cover disks 32 and 33. In particular, the shape of the nonparallel-surface cover disk can here be such that at least approximately the surface area of the cylinder jacket through which flow occurs remains constant for each radius between the blade outlet edges and the outlet connectors 20.

The invention is represented merely as an example using the embodiment examples in the description and in the drawing, to which it is not limited, but rather it comprises all the variants, modifications, substitutions or combinations that a person skilled in the art can obtain from the available documentation, particularly in the context of the claims and the general representations in the introduction of this description as well as the description of the embodiment example and their representations in the drawing, and combine with his knowledge of a person skilled in the art as well as with the state of the art. In particular, all the individual characteristics and design possibilities of the invention and their embodiment variants can be combined.

LIST OF REFERENCE CHARACTERS

1 Jet mill
2 Cylindrical housing
3 Milling chamber
4 Mill material feed
5 Milling jet inlet
6 Product outlet
7 Air classifier
8 Sieve wheel
9 Inlet opening or inlet nozzle
10 Milling jet
11 Heat source
12 Heat source
13 Feed pipe
14 Heat insulating jacket
15 Inlet
16 Outlet
17 Center of the milling chamber
18 Reservoir or production installation
19 Line devices
20 Outlet connectors
21 Sieve housing
22 Housing upper part
23 Housing bottom part
24 Circumferential flange
25 Circumferential flange
26 Articulation
27 Arrow
28 Sieve space housing
**28*a*** Support arms
29 Discharge cone
30 Flange
31 Flange
32 Cover disk
33 Cover disk
34 Blade
35 Sieve wheel shaft
**35*a*** Pivot bearing
36 Upper machined plates
37 Bottom machined plate
38 Housing end section
39 Product feed connector
40 Axis of rotation
41 Outlet chamber
42 Upper cover plate
43 Removable cover
44 Support arms
45 Conical annular housing
46 Suction filter
47 Perforated plate
48 Fine material discharge pipe
49 Rejection cone
50 Sieve air inlet spiral
51 Coarse material discharge
52 Flange
53 Flange
54 Dispersion zone
55 Flange whose inner edge has been machined (chamfered) and casing
56 Replaceable protection pipe
57 Replaceable protection pipe
58 Fine material outlet/inlet
59 Blade ring

The invention claimed is:

1. Method for producing very fine particles by a jet mill comprising the steps of:

a) using compressed gases having a pressure of ≦4.5 bar absolute pressure as a grinding gas;

b) introducing inorganic substances to be ground by the jet mill;

c) maintaining the temperature of the grinding gas above 100 degrees Centigrade;

d) initially determining the specific adiabatic energy consumption of the grinding process of the jet mill using a grinding gas pressure of >7 bar absolute pressure;

e) thereafter, determining the specific adiabatic energy consumption of the same grinding process of the jet mill using a grinding gas pressure of <4.5 bar absolute pressure;

f) comparing the two energy consumptions; and g) in the case where $$E_{ad,spec}(4.5) \leqq E_{ad,spec}(7)$$

continuing the grinding process of the jet mill using the low pressure area.

2. Method according to claim 1, wherein the temperature of the grinding gas is maintained between about 180° C. and about 200° C.

3. Method according to claim 1, wherein the determinations of the two energy consumptions and their comparison are carried out at each startup of operation or resumption of operation of the jet mill.

4. Method according to claim 3, wherein the determinations of the two energy consumptions and their comparison are carried out automatically.

5. Method according to claim 4, including the further step of setting an operating mode automatically in accordance with the result of the comparison.

6. Method according to claim 1, wherein the jet mill is one of a fluidized bed jet mill and a dense bed jet mill.

7. Method according to claim 1, including the further step of integrating a dynamic air classifier with the jet mill.

8. Method according to claim 7, including the further step of operating the air classifier to maintain flow approximately constant by using a rotating sieve with a clearance height that increases with decreasing radius.

9. Method according to claim 7 including the further step of providing a replaceable immersion pipe, designed so that it turns with the rotating sieve.

10. Method according to claim 1, including the further step of providing a fine material outlet chamber for the jet mill, which presents a cross-sectional enlargement in the flow direction.

* * * * *